US005259150A

United States Patent [19]

Himmelsbach

[11] Patent Number: 5,259,150

[45] Date of Patent: Nov. 9, 1993

[54] METHOD FOR GRINDING CAMS

[75] Inventor: Georg Himmelsbach, Haslach, Fed. Rep. of Germany

[73] Assignee: Erwin Junker, Nordrach, Fed. Rep. of Germany

[21] Appl. No.: 824,437

[22] Filed: Jan. 23, 1992

[30] Foreign Application Priority Data

Feb. 1, 1991 [DE] Fed. Rep. of Germany ..... 4103090

[51] Int. Cl.[5] ..... B24B 1/00

[52] U.S. Cl. ..... 51/281 C; 51/326; 51/327

[58] Field of Search ..... 51/281 C, 326, 327, 51/206 R, 206 P, 80 R, 80 A, 81 R, 88, 89, 105 EC

[56] References Cited

U.S. PATENT DOCUMENTS

| | | | |
|---|---|---|---|
| 3,019,562 | 2/1962 | Price | 51/105 R |
| 4,151,685 | 5/1979 | Frangipane | 51/206 P |
| 4,373,301 | 2/1983 | Parnum et al. | 51/281 C |
| 4,527,356 | 7/1985 | Ozone et al. | 51/281 C |
| 4,528,781 | 7/1985 | Koide et al. | 51/281 C |
| 4,624,610 | 11/1986 | Phillips et al. | 51/281 C |
| 4,841,676 | 6/1989 | Barwasser | 51/206 R |
| 4,841,679 | 6/1989 | Riemscheid et al. | 51/281 C |
| 4,885,874 | 12/1989 | Wedeniwski | 51/281 C |
| 4,905,418 | 3/1990 | Wedeniwski | 51/281 C |
| 4,930,265 | 6/1990 | Belthle | 51/206 P |
| 5,024,026 | 6/1991 | Korb | 51/206 P |

FOREIGN PATENT DOCUMENTS

| | | | |
|---|---|---|---|
| 3724698 | 2/1989 | Fed. Rep. of Germany . | |
| 54-83195 | 3/1979 | Japan . | |
| 2073069 | 10/1981 | United Kingdom | 51/281 C |

*Primary Examiner*—Bruce M. Kisliuk
*Assistant Examiner*—Bo Bounkong

[57] ABSTRACT

A method for grinding the outer contour of a cam wherein the cam is rough-ground with a roughing wheel having circumferential grooves in its surface. After a first radial infeed, the grinding wheel is withdrawn and axially displaced for a second infeed. This process is repeated until the cam is rough-ground. A rough grinding wheel for use in this method has a plurality of annular grooves with widths at the surface of the grooves that are less than the widths thereof at the bottoms of the grooves. This feature provides a space for fluid during the grinding process. A finishing wheel may be mounted on a common shaft with the rough grinding wheel.

2 Claims, 2 Drawing Sheets

METHOD FOR GRINDING CAMS

FIELD OF THE INVENTION

The invention relates to a method for grinding cams.

BACKGROUND OF THE INVENTION

In a known method of this kind (DE 37 24 698 Al) a roughing grinding wheel has the from of an interchangeable grinding wheel which can be removed from the brinding spindle. This interchangeable grinding wheel has sections to break the edges of the cams during roughing. During the grinding procedure the roughing wheel is not displaced laterally; instead the cam contour is roughed by a single plunge cut prior to the interchangeable grinding wheel being removed. A different roughing wheel is required for each cam width or for each chamfer form. During roughing the contact surface between the grinding wheel and the workpiece is large, to which no coolant is able to find access. This results in the feed rate having to be kept relatively low since excessively increasing the feed rate or cutting volume per unit of time would heat up the workpiece too rapidly. This in turn produces grinding cracks in the surface or even a change in the structure of the workpiece which is, of course, not wanted. This known method of grinding can be employed only to a limited extent also with new materials finding increasing application, especially e.g., hard shell castings or materials exhibiting quite different properties when being machined that those normally used formerly.

U.S. Pat. No. 3,019,562 and JP Abstract 54-83195 also described working with two grinding disks, the roughing being done with a roughing wheel having a cylindrical grinding surface and the outer surface of the cam then being finished by means of a separate finishing wheel once roughing has been completed after one or more rotations of the workpiece. Here too, the disadvantages involved in excessive heating occurs as already mentioned in conjunction with DE 37 24 698 Al.

SUMMARY OF THE INVENTION

The object of the invention is thus to avoid these disadvantages and to teach a method for grinding in which, in particular, specific cooling of the grinding zone is possible during roughing.

By configuring the roughing wheel with at lest one radial circumferential groove on the outer circumference it is achieved that the complete peripheral surface of the cam is not machined in one pass. This introduces a reduction in the amount of heating which in turn contributes towards enabling a coolant to be introduced at the lands remaining in the groove during grinding. Accordingly, high cutting rates and an increased cutting volume per unit of time are possible, i.e. feed rate and bite can be increased so that, even in high-speed machining, changes in the structure or grinding cracks in the workpiece are eliminated.

This enables faster and, accordingly, more cost-effective grinding. Furthermore, the roughing and finishing wheels can be selected with differing grit sizes, properties and compositions to positively affect the grinding parameters.

DR

BRIEF DESCRIPTION OF THE DRAWING

The invention will now be described in more detail on the basis of the embodiments shown in the drawings in which.

DESCRIPTION OF THE PREFERRED EMBODIMENTS

Figure 4:
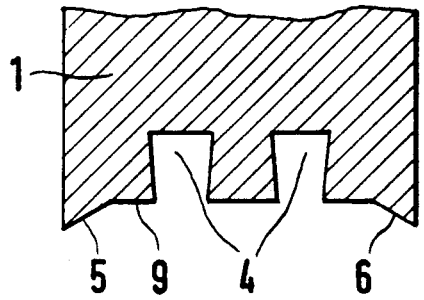
FIG. 4 shows a cross-section through the grinding surface of the roughing wheel.
Figure 2:
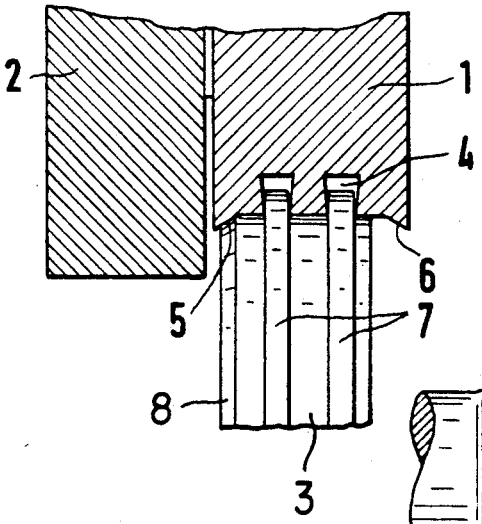
FIG. 2 shows the roughing wheel in plunge-cut grinding.

FIG. 2 shows how a cam 3 is rough-ground by plunge-cutting. "Plunge-cutting" of cams is understood by those skilled in the art to mean cutting only by relative radial movements. The roughing wheel 1 is wider than the cam 3 and features two radial annular grooves 4 on its outer circumference. The grooves 4 become wider inwards so that between the flanks of the grooves 4 and the lands 7 remaining during grinding clearance angles result in which a coolant can be introduced. The actual grinding surface does not cover the full width of the cam. This is particularly obvious in FIG. 4 which shows that an electroplated grinding coating 9 is interrupted by the grooves 4. This grinding wheel can also be produced with a metal-cemented CBN grinding coating.

Figure 7:
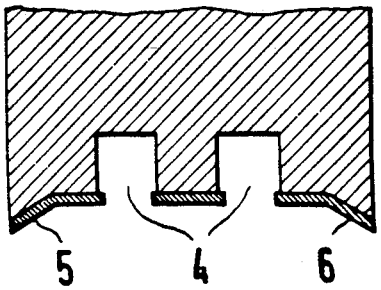
FIG. 7 shows a modified embodiment of the radial grooves on the circumference of the grinding wheel.

Another embodiment of the roughing wheel is shown in FIG. 7. Here , the grinding coating is produced to slightly protrude over the side surface of the grooves 4 so that the grooves 4 running radially around the outer circumference can be machined to hone a constant width down to the bottom of the groove. This embodiment achieves the same advantages as the embodiment according to FIG. 4.

When grinding in accordance with FIG. 2 the chamfer 8 of the cam 3 shown on the left of the Figure is simultaneously ground. For this purpose the roughing wheel 1 has protruding edges 5 and 6 which can be freely selected in cross-section to be roughly triangular according to FIG. 2 or FIG. 3, their inclination corresponding to the desired profile of the chamfers 8.

Figure 3:
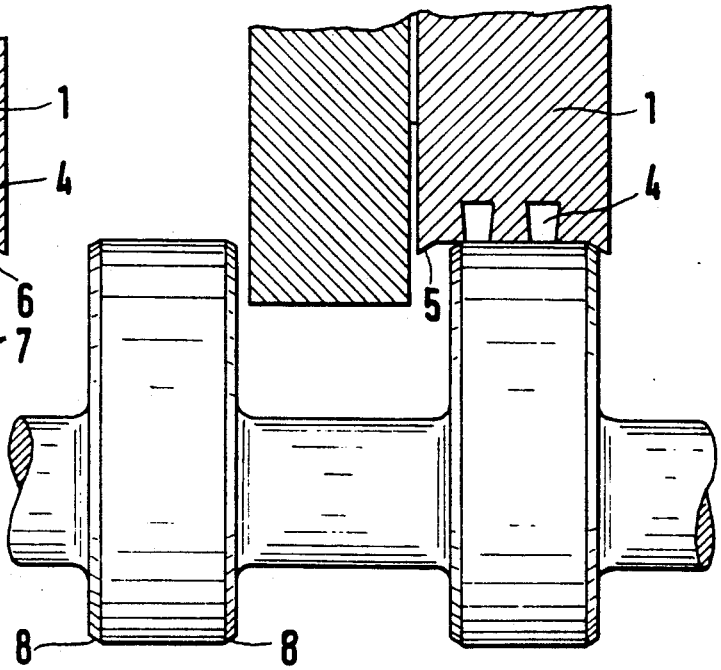
FIG. 3 shows finish rough-grinding of a cam following axial displacement of the roughing wheel.

As can be seen from FIG. 2 the edge 6 on the right and a neighbouring region of the grinding surface are not in contact with the cam 3 due to greater width of the roughing wheel 1 with respect to cam 3. Once roughing has progressed sufficiently so that the lands 7 penetrate into the grooves 4 a certain distance, the roughing wheel 1 is radially withdrawn in accordance with conventional plunge-cutting practice and then axially displaced. The roughing wheel 1 is used after the first plunge cut for at least one further plunge cut with the roughing wheel 1 being displaced by at least the dimension of the groove width in the axial direction of the grinding wheel. The lands 7—now positionally displaced with respect to the grooves 4—are then ground off while, at the same time, the chamfer 8 on the right is ground by the edge 6. The condition attained after this procedure following radial infeed of the grinding wheel is shown in FIG. 3.

Rough-grinding may be finished after once-only axial displacement of the roughing wheel 1, but, if necessary, further grinding cycles may follow. In any case, displacement of the roughing wheel is repeated as often as required until the finished roughing dimension is attained, whereby each grinding procedure is made for a single full rotation of the workpiece or several rotations thereof.

Figure 1:
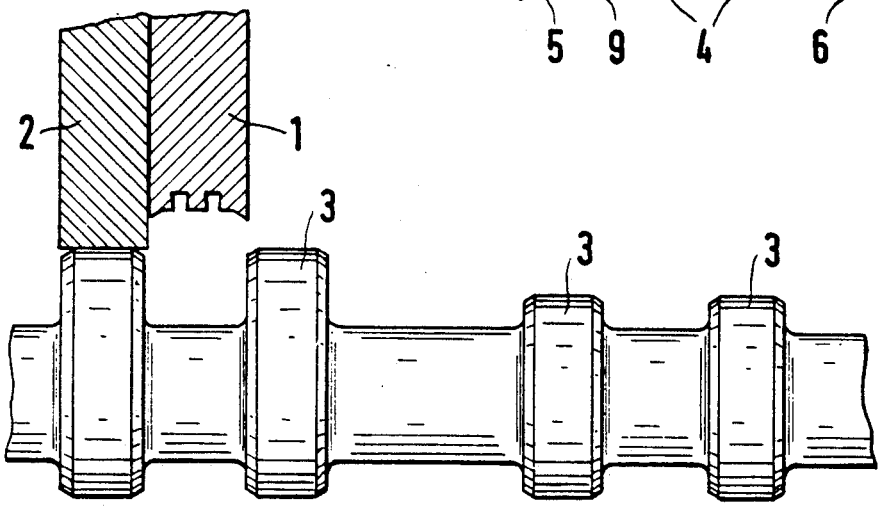
FIG. 1 shows the apparatus according to the invention for finish-grinding a cam.

Once the finished roughing dimension is attained the cam 3 is finish-ground by the finishing wheel 2. This is shown in FIG. 1. The outer circumference of the finishing wheel 2 features for this purpose the finished profile form of the cam 3. In FIG. 3 the finishing wheel 2 has a cylindrical outer circumference, it being, however, quite possible that the finishing wheel 2 can also be utilized to grind slanting or barrel-shaped cams; it then merely requiring a corresponding profile shape.

The finishing wheel may have a different grit and cement than that of the roughing wheel to achieve the desired surface and to effectively influence the grinding parameters. By finishing the two chamfers 8 during rough-grinding with the roughing wheel, the finishing wheel may have a very simple profile shape. In addition, no transverse forces occur at all at the finishing wheel and/or the workpiece during finishing which could negatively influence the machining accuracy, i.e. the grinding wheel and/or the camshaft are subject exclusively to radial loading.

Figure 5:
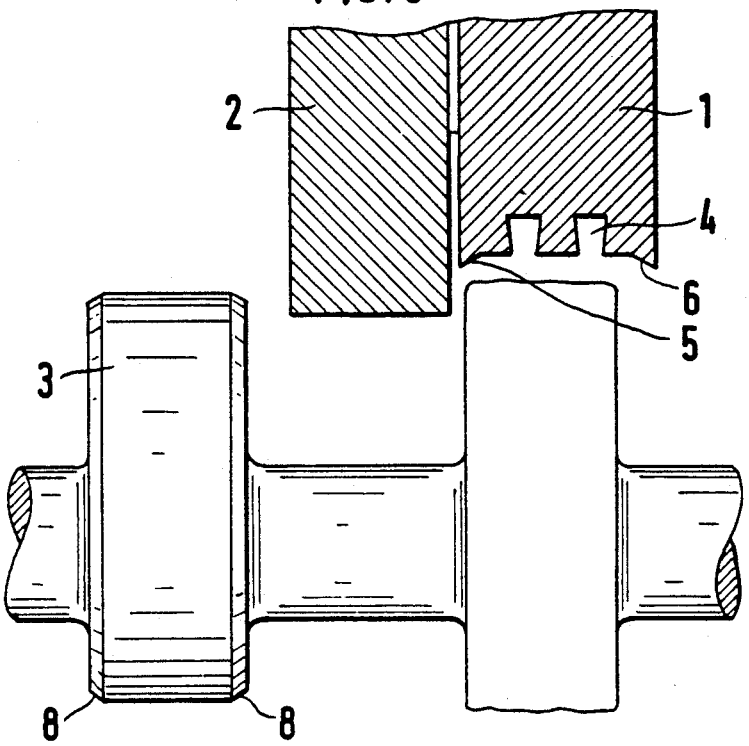
FIG. 5 shows the apparatus prior to commencing roughing, after a neighbouring cam has already been finished.

FIG. 5 shows cam 3 finish-ground while the neighbouring cam still has the rough cast wheel surface. Here, the roughing wheel 1 is positioned immediately prior to first application, the result of which corresponds to the situation as shown in FIG. 2.

In FIGS. 1 thru 3 and in FIG. 5 both grinding wheels 1 and 2 are mounted on a common spindle, this arrangement permitting rough and finish grinding the cam 3 in a single clamping operation.

Figure 6:
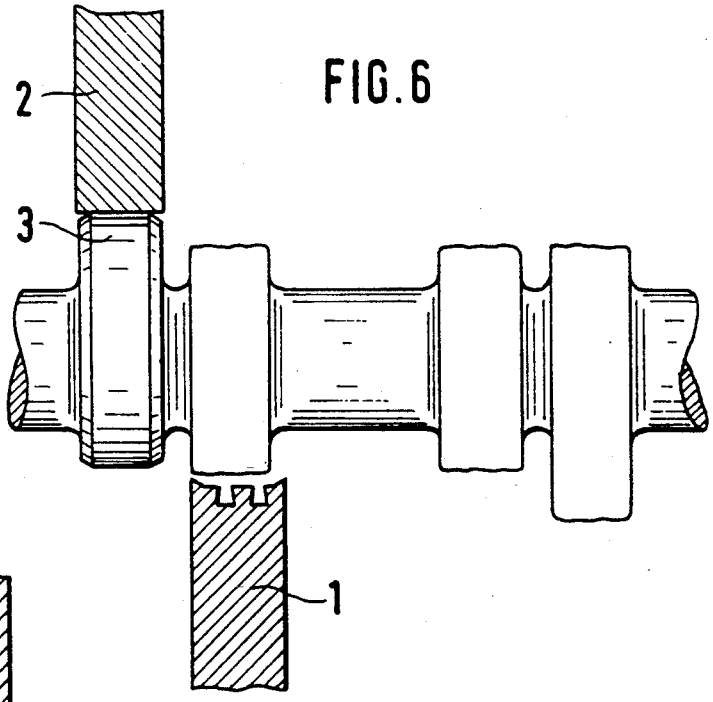
FIG. 6 shows a modified embodiment having grinding wheels mounted facing each other.

If the cams are mounted very close to each other it is not possible to machine them with the grinding wheels 1 and 2 mounted on a common spindle. In this case the grinding wheels 1 and 2 are arranged facing each other on the camshaft; viz. FIG. 6 where two grinding spindles are provided.

What is claimed is:

1. In a method for grinding the outer contour of a cam comprising rough-grinding the cam with a roughing wheel in a plunge cut to a prescribed roughing dimension and then fishing grinding the cams with a finishing wheel;

the improvement wherein said step of rough-grinding comprises:

grinding said cam in a first plunge cut to said roughing dimension with a roughing wheel having at least one radial circumferential groove on its outer circumference, then withdrawing said roughing wheel, displacing said roughing wheel axially by the dimension of the width of said groove, and then grinding said cam with said roughing wheel in a second plunge cut at its axially displaced position.

2. The method according to claim 1 comprising rotating said cam with at least one revolution during said rough-grinding of said cam.

* * * * *